United States Patent [19]

Schultheiss

[11] Patent Number: 4,674,559

[45] Date of Patent: Jun. 23, 1987

[54] CONTINUOUS CASTER

[75] Inventor: Alfons Schultheiss, Engelsbrand, Fed. Rep. of Germany

[73] Assignee: INRESA Schultheiss GmbH, Engelsbrand, Fed. Rep. of Germany

[21] Appl. No.: 823,452

[22] Filed: Jan. 28, 1986

[30] Foreign Application Priority Data

Jan. 28, 1985 [DE] Fed. Rep. of Germany ..... 3502704

[51] Int. Cl.[4] ..... B22D 11/04; B22D 11/10; B22D 27/02

[52] U.S. Cl. ..... 164/507; 164/435; 164/439

[58] Field of Search ..... 164/439, 507, 513, 435, 164/471

[56] References Cited

U.S. PATENT DOCUMENTS

| | | | |
|---|---|---|---|
| 2,264,288 | 12/1941 | Betterton et al. | 164/439 |
| 2,740,177 | 4/1956 | Smart, Jr. | 164/439 X |
| 3,189,957 | 6/1965 | Luteijn | 164/439 X |
| 3,425,484 | 2/1969 | McKay | 164/439 X |
| 3,916,985 | 11/1975 | English | 164/439 |
| 4,341,261 | 7/1982 | Thomson et al. | 164/471 X |
| 4,566,525 | 1/1986 | Li et al. | 164/423 X |

FOREIGN PATENT DOCUMENTS

| | | | |
|---|---|---|---|
| 1250771 | 12/1960 | France | 164/439 |

*Primary Examiner*—J. Reed Batten, Jr.
*Attorney, Agent, or Firm*—Spencer & Frank

[57] ABSTRACT

In a continuous caster including a crucible for metal to be melted and a mold coupled to the crucible, the crucible and the mold can be screwed together so that easy removal and replacement of the mold is possible. The crucible and the upper part of the mold are surrounded by an induction heating coil to maintain the metal in a molten condition. A gasket of zirconium oxide is clamped between the mold and the crucible.

3 Claims, 1 Drawing Figure

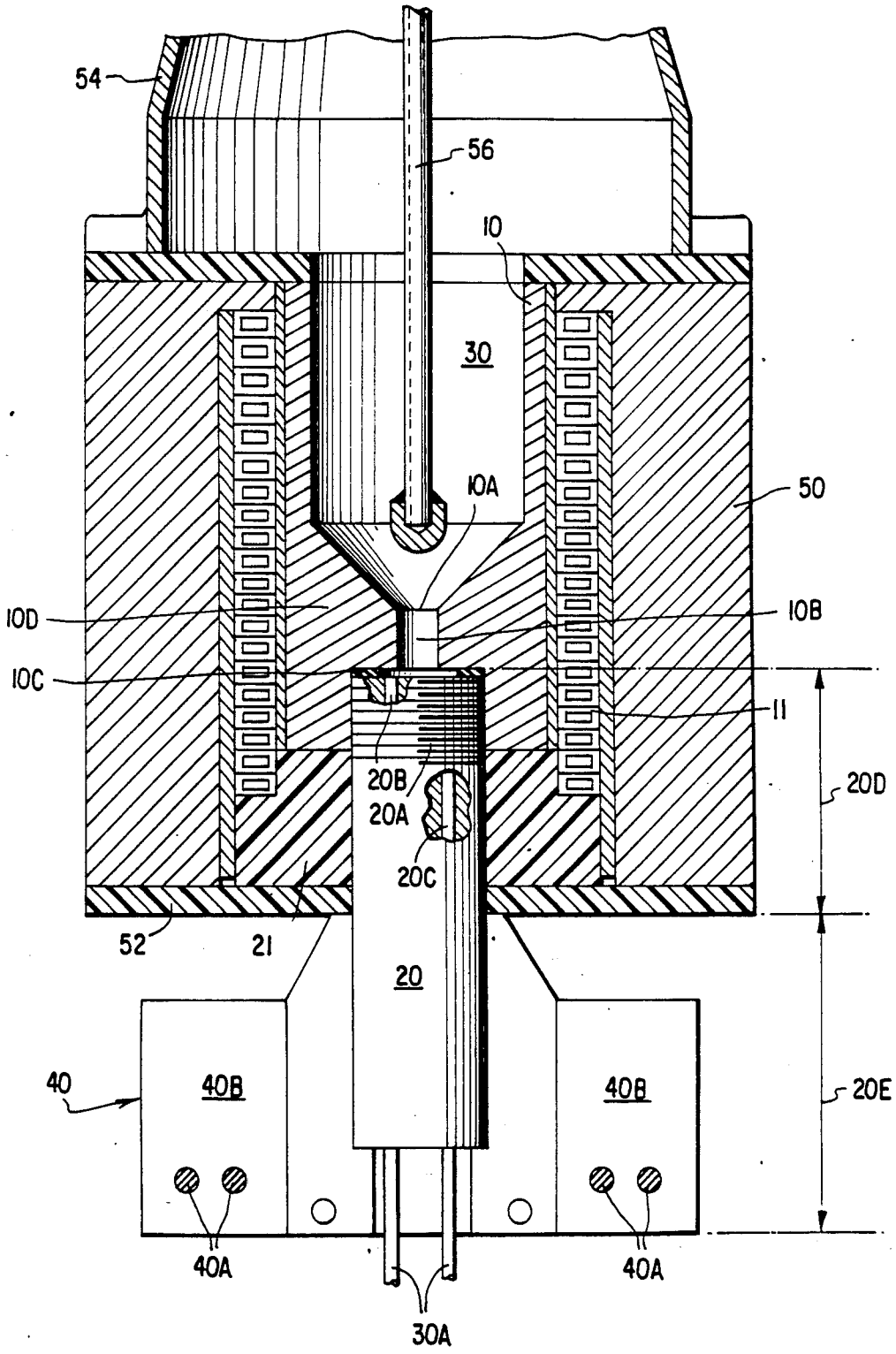
54
56
10
30
10A
50
10D
10B
10C
11
20B
20A
20D
20C
52
21
20
40
40B
40B
20E
40A
40A
30A

CONTINUOUS CASTER

BACKGROUND OF THE INVENTION

The present invention relates to a continuous caster including a crucible for metal to be melted and a mold which is coupled with the crucible.

In known continuous casters, molten metal is sealed off in that the crucible and mold are compressed under pressure horizontally as well as vertically by means of a mechanical compression device and through the intermediary of a seal. This of course requires additional equipment.

It is also known to manufacture the crucible and mold of the same material and in one piece. This, however, involves much greater expenditures for material and material of the same quality is not identically suitable for the crucible and the mold alike so that it will be necessary either to make compromises or to replace the entire crucible and mold unit when one part thereof wears out prematurely.

SUMMARY OF THE INVENTION

It is an object of the present invention to improve the crucible-mold combination of a continuous caster and to avoid the above-described drawbacks.

The above and other objects are achieved, according to the invention by making the crucible and mold of two separate pieces which are configured so that they can be screwed together. In particular, according to the invention, the mold is equipped with a threaded projection which can be screwed into a threaded bore in the crucible.

This produces an optimum connection and seal between crucible and mold, permits easy replaceability of either of these two continuous caster components, and enables the best suited material to be selected for the crucible as well as for the mold in consideration of the alloy to be melted and cast. If either piece becomes useless due to wear, it is easily possible to replace it. Separate components, such as clamping devices or the like, are here not required.

Thus there results a considerable savings in costs with optimum casting quality.

BRIEF DESCRIPTION OF THE DRAWING

The sole FIGURE is an elevational view, partly in cross section, of a preferred embodiment of the invention.

DESCRIPTION OF THE PREFERRED EMBODIMENTS

The sectional view of the FIGURE shows a crucible 10 having a downwardly oriented discharge channel 10B which is disposed coaxially with a mold (or dies) 20. Crucible 10 is made of coarse-grained graphite that has a low electric resistance and is much cheaper than fine grained graphite which is used for the mold 20.

Crucible 10 is embedded in an induction heating system essentially consisting of an induction coil 11, under the influence of which an alloy 30 in the crucible 10 can be liquefied, thus leaving the crucible 10 by the pouring channel 10B in liquid condition. At the inlet end of channel 10B, crucible 10 presents a degassing and mixing area 10A. A temperature control for the molten alloy can be disposed in region 10D of crucible 10.

Such an alloy may consist of several components such as yellow gold (Au), silver (Ag), copper (Cu); for jewellery products to be cast the alloy may consist of:

58.5 weight percent Au;
20.0 weight percent Ag;
15.0 weight percent Cu;
6.5 weight percent Zn.

At its bottom, crucible 10 has an annular extension provided with a threaded bore into which a mating threaded projection 20A of mold 20 can be screwed. Mold 20 has a cylindrical shape and includes at least one cast channel 20B the cross section of which depends on the cross section of the desired cast product. In the embodiment of the FIGURE there are two cast channels 20B, 20C running parallel to each other and the longitudinal axis of mold 20. Thus, the cast product 30A will be a 5 mm-diameter wire that can be bent to form different jewellery articles.

According to the phase condition of the alloy to be cast (molten or solid), the mold 20 can be separated in two parts: upper part 20D, extending into the bore of crucible 10 and being surrounded by an annular isolating unit 21 of aluminum oxide, and lower part 20E projecting below unit 21. Upper part 20D is influenced by the magnetic field of induction coil 11, which for that purpose extends below the lower front side of crucible 10.

Crucible 10, coil 11 and upper part 20D of mold 20 are surrounded by a casing 50 composed of aluminum oxide casting cement. The lower end of casing 50 and the bottom of unit 21 are covered by an insulating bottom plate 52. The region above crucible 10 is enclosed by a cover 54 which serves to contain an inert gas atmosphere. The structure is completed by a sealing rod 56 for selectively blocking discharge channel 10B.

Under the influence of the magnetic field the molten metal or alloy 30 entering the mold 20 through pouring channel 10B is kept in liquid condition and an additional degassing and mixing effect is exerted on the molten alloy which leads to an improvement of homogeneity and quality of the product to be cast.

The lower part 20E of mold 20 is in close contact with a cooling device 40 essentially including water channels 40A in a copper block 40B; the temperature of the cooling device 40 (which is controlled by a control device not shown) is chosen under the solidification temperature of the molten alloy; hence, solidification will take place in this lower part 20E, and the rod like cast products leaving the mold 20 may be conveyed by appropriate tools known per se.

An annular gasket 10C is placed between the frontal faces of upper part 20D and the bottom of threaded bore of crucible 10. Gasket 10C is made of very soft zirconium-oxide thus accounting for differential thermal expansion of crucible and mold.

It will be understood that the above description of the present invention is susceptible to various modifications, changes and adaptations, and the same are intended to be comprehended within the meaning and range of equivalents of the appended claims.

What is claimed is:

1. In a continuous caster for casting molten metal, including: a crucible having a bottom provided with a discharge channel, and a mold communicating with the discharge channel for receiving molten metal from the crucible, the improvement wherein:

said crucible is provided, at its bottom, with an internally threaded bore coaxial with, and larger in diameter than, said discharge channel, said bore having an annular end face surrounding said discharge channel;

said mold is of a material different from that of said crucible and is composed of: an upper part extending to a point spaced downwardly from said crucible bottom and having an upper end region carrying an external thread forming a screw connection with said internally threaded bore; and a lower part projecting downwardly from said upper part; and said caster further comprises:

an induction heating coil for maintaining metal in said crucible in a molten condition and for exerting a degassing and mixing effect on the molten metal, said coil surrounding said crucible and extending downwardly below said crucible bottom so as to surround at least a portion of said upper part of said mold;

a body of insulation material located below said crucible and surrounding said upper part of said mold;

a cooling device surrounding said lower part of said mold;

an annular gasket of soft zirconium oxide clamped between said annular end face of said bore and said upper part of said mold for providing a seal which compensates for differences in thermal expansion between said crucible and said mold; and a sealing member movable within said crucible for selectively closing said discharge channel.

2. A caster as defined in claim 1 wherein said body of insulation material is composed of aluminum oxide.

3. A caster as defined in claim 1 further comprising a second body of insulation material surrounding said crucible and said first-recited body of insulation material.

* * * * *